US007556537B2

(12) United States Patent
Schenk et al.

(10) Patent No.: US 7,556,537 B2
(45) Date of Patent: Jul. 7, 2009

(54) SOLENOID AND CONNECTOR ASSEMBLY

(75) Inventors: Rebecca Lynn Schenk, Indianapolis, IN (US); Joshua Gilberg, Indianapolis, IN (US); Thomas H. Wilson, Indianapolis, IN (US)

(73) Assignee: GM Global Technology Operations, inc., Detroit, MI (US)

( * ) Notice: Subject to any disclaimer, the term of this patent is extended or adjusted under 35 U.S.C. 154(b) by 0 days.

(21) Appl. No.: 11/940,801

(22) Filed: Nov. 15, 2007

(65) Prior Publication Data

US 2009/0130868 A1 May 21, 2009

(51) Int. Cl.
*H01R 13/04* (2006.01)

(52) U.S. Cl. ..... 439/694; 439/577; 439/353; 439/378

(58) Field of Classification Search ..... 439/620.07, 439/582, 620.01, 694, 468, 378, 577, 353; 333/181–185; 310/71
See application file for complete search history.

(56) References Cited

U.S. PATENT DOCUMENTS

| | | | | |
|---|---|---|---|---|
| 6,152,775 | A * | 11/2000 | Pavlovic | 439/620.07 |
| 6,234,843 | B1 * | 5/2001 | Pavlovic | 439/620.07 |
| 6,547,596 | B1 * | 4/2003 | Pavlovic et al. | 439/620.07 |
| 6,979,216 | B2 * | 12/2005 | Maeda et al. | 439/260 |
| 7,241,175 | B2 * | 7/2007 | Johannes et al. | 439/620.05 |

* cited by examiner

*Primary Examiner*—Neil Abrams
*Assistant Examiner*—Phuong Nguyen

(57) ABSTRACT

The present invention provides a solenoid and electrical connector assembly which includes a solenoid body having a pair of electrical terminals disposed on opposite sides of a plunger component and a connector having two corresponding electrical terminals and a non-conductive blade or tongue disposed therebetween. When assembled, the tongue of the connector seats between the terminals on the solenoid body and inhibits corrosion and ingress of foreign matter in the region between the terminals of the solenoid.

19 Claims, 5 Drawing Sheets

SOLENOID AND CONNECTOR ASSEMBLY

FIELD

The present disclosure relates to electrical connectors and electrical devices and more particularly to an assembly of an electrical device such as a motor or solenoid and an electrical connector having improved reliability.

BACKGROUND

The statements in this section merely provide background information related to the present disclosure and may or may not constitute prior art.

Compact electrical devices such as motors and solenoids are often housed in cylindrical housings which correspond generally to the active components of the device: a rotor surrounded by a cylindrical stator in the case of a motor or a plunger surrounded by a cylindrical coil in the case of a solenoid. Such cylindrical housings are efficient packages for such devices as they generally require a minimum of material and result in a package having minimum dimensions.

Since one end of a typical motor or solenoid will include an output feature, either a shaft or a plunger, it is frequently convenient to arrange the electrical input or terminals on the opposite end. Input connections or terminals so located also maintain the cylindrical symmetry of the housing.

A problem may develop with such an arrangement, however, especially in smaller devices in which the spacing between the motor shaft, solenoid plunger or other electrically components associated with them and the electrical terminals is limited. In such situations, conductive foreign matter may bridge the gap between an electrical terminal and the shaft or plunger and intermittently or permanently short circuit the device.

This problem can be especially acute in motors and solenoids for automotive applications because of the constant demand for weight saving which generally encourages lighter and therefore smaller devices and the fact that they are often exposed to deleterious atmospheric conditions such as dirt, metallic debris and other contaminants and particulates. Furthermore, a failure of the motor or solenoid due to a short circuit to ground may cause consequential failure of related components or controllers. The present invention addresses this difficulty with motors, solenoids and other similar electrical devices.

SUMMARY

The present invention provides a solenoid and electrical connector assembly which includes a solenoid body having a pair of electrical terminals disposed on opposite sides of a plunger component and a connector having two corresponding electrical terminals and a non-conductive blade or tongue disposed therebetween. When assembled, the tongue of the connector seats between the terminals on the solenoid body and inhibits ingress of foreign matter in the region between the terminals of the solenoid. The service life and reliability of the solenoid are thus greatly improved.

The invention is also suitable for and may be utilized with a motor having a bearing at one end and a pair of electrical terminals disposed on opposite sides of the bearing. The electrical connector includes a pair of electrical terminals correspondingly arranged and a blade or tongue which seats between the terminals of the motor and protects the bearing from foreign matter thereby reducing the likelihood of a short circuit.

Thus it is an object of the present invention to provide a solenoid and connector assembly having a tongue disposed between a pair of terminals.

It is a further object of the present invention to provide a solenoid having a pair of terminals on opposite sides of a plunger component and a connector having a corresponding pair of terminals and a tongue between the terminals which protects the plunger component when the solenoid and connector are assembled.

It is a still further object of the present invention to provide a solenoid having a pair of terminals on opposite sides of a plunger and a connector having a corresponding pair of terminals and a tongue between the terminals which covers the plunger when the solenoid and connector are assembled to inhibit ingress of foreign matter.

It is a still further object of the present invention to provide a motor having a pair of terminals on opposite sides of a bearing and a connector having a corresponding pair of terminals and a tongue between the terminals which protects the bearing when the motor and connector are assembled.

It is a still further object of the present invention to provide a motor having a pair of terminals on opposite sides of a bearing and a connector having a corresponding pair of terminals and a tongue between the terminals which covers the bearing when the motor and connector are assembled to inhibit ingress of foreign matter.

Further objects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
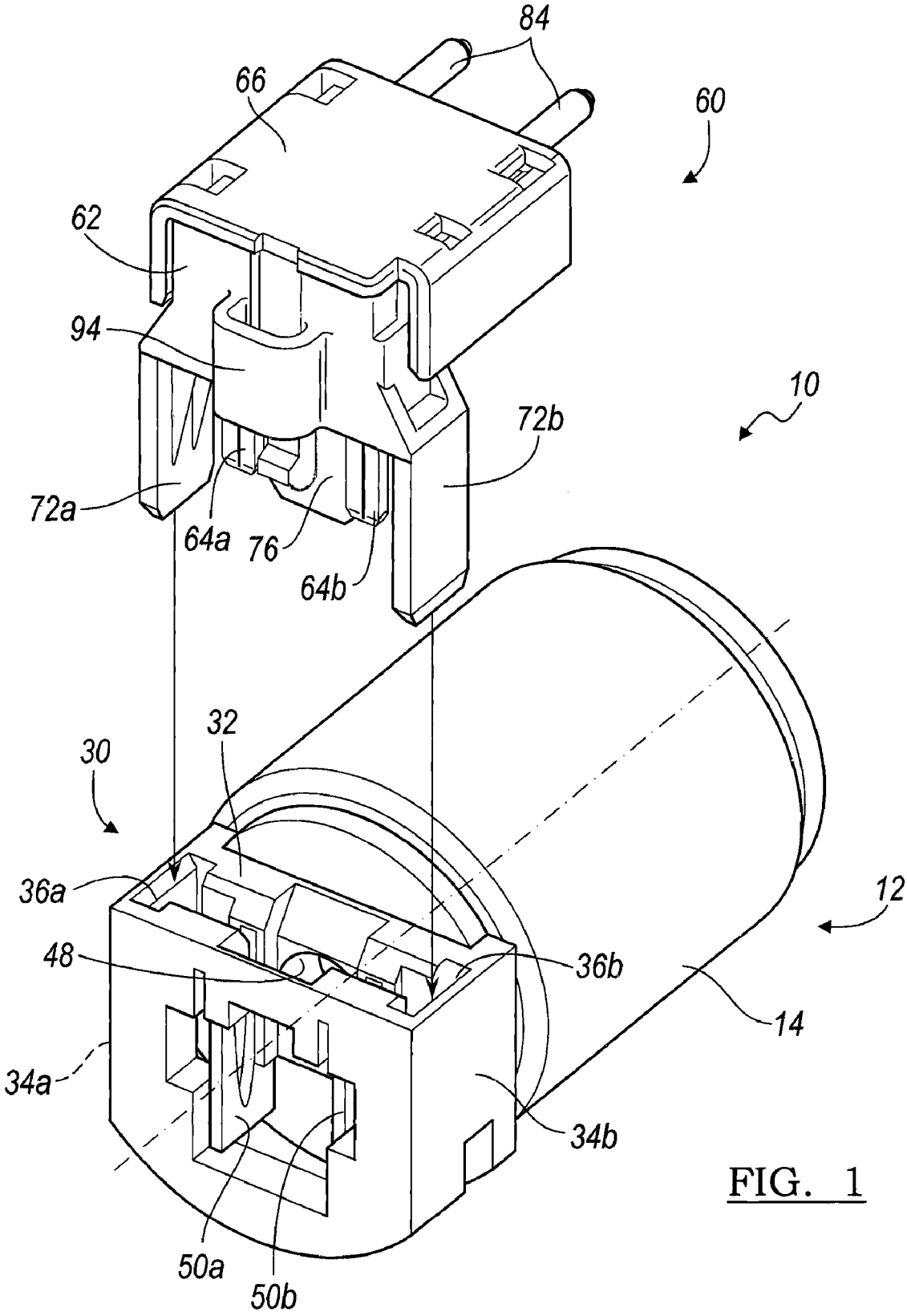
FIG. 1 is a perspective view of a first embodiment of a solenoid and an electrical connector according to the present invention in pre-assembly configuration.
Figure 2:
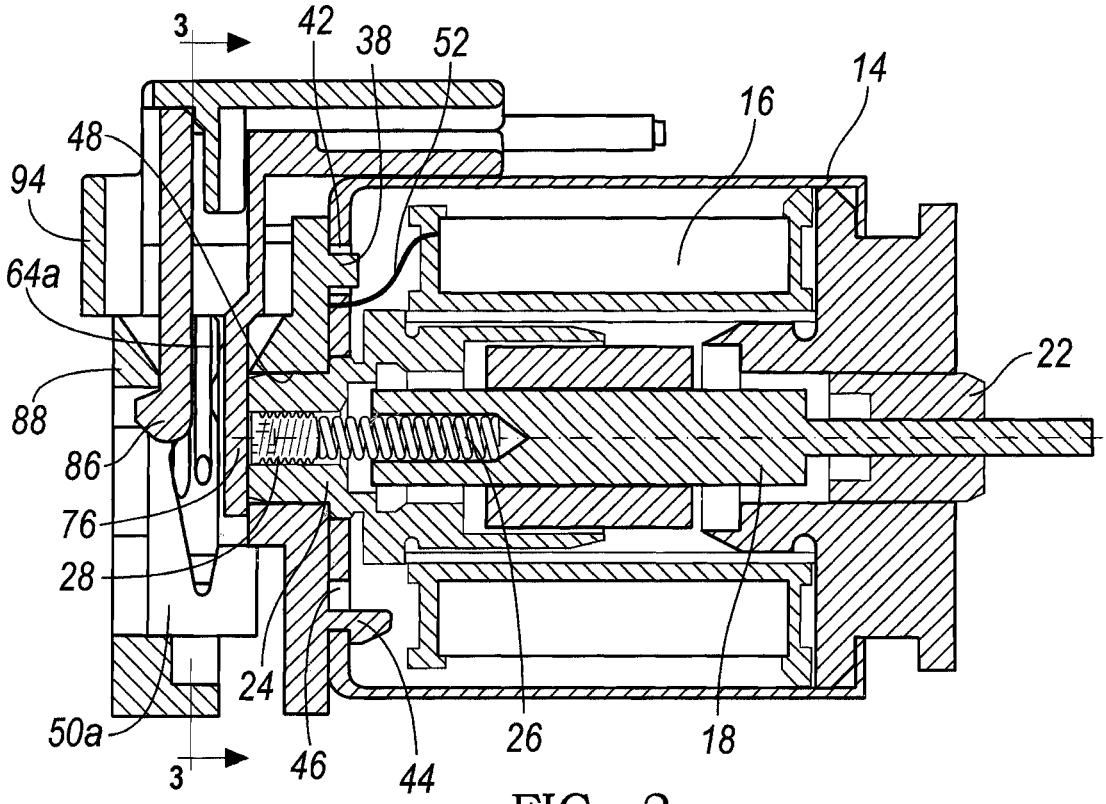
FIG. 2 is a full, sectional view of a first embodiment of a solenoid and an electrical connector assembly according to the present invention.

With reference now to FIGS. 1 and 2, a first embodiment of a solenoid and electrical connector assembly is illustrated and generally designated by the reference number 10. The first embodiment solenoid and electrical connector assembly 10 includes a solenoid 12 having a generally cylindrical body or housing 14 which is preferably fabricated of metal, for example, steel, aluminum or an alloy of these or other metals.

The cylindrical housing 14 locates, supports and protects an electrical coil 16. The electrical coil 16 generally surrounds a bi-directionally translatable armature or plunger 18. The plunger 18 cooperates with a first axial guide or bearing 22 and a second axial guide, pole piece or stop 24 which together define the axis of motion or translation of the plunger 18. A portion of the plunger 18 extends through the first axial guide or bearing 22 and activates or controls an associated device (not illustrated). If desired, a compression spring 26 and an adjusting screw 28 may be disposed between the plunger 18 and the second axial guide, pole piece or stop 24 for adjusting the travel of the plunger 18

At the end of the cylindrical housing 14 adjacent the second axial guide, pole piece or stop 24 is disposed a terminal assembly 30. The terminal assembly 30 is fabricated of a plastic, insulating material, for example, ABS or nylon, and is shaped to generally conform to the housing 14 of the solenoid 12 and includes a flat, chordal surface 32 flanked by two smaller perpendicular surfaces 34*a* and 34*b*. The terminal assembly 30 defines a pair of rectangular slots 36*a* and 36*b* parallel to and adjacent the surfaces 34*a* and 34*b*. The terminal assembly 30 is secured to the housing 14 by a positioning or register pin 38 which is received within a suitably sized and appropriately located opening 42 and a resilient or flexible latch 44 which is releasably received within a second opening 46 having a flat or chordal edge which is engageable by the flexible latch 44.

The terminal assembly 30 includes a centrally disposed aperture 48 which receives a portion of the second guide, pole piece or stop 24. The terminal assembly 30 also includes a pair of spaced apart electrical terminals 50*a* and 50*b* disposed adjacent and on opposite sides of the center aperture 48. Each of the terminals 50*a* and 50*b* is connected by one of a pair of electrical leads or wires 52 to the electrical coil 16.

Referring now to FIGS. 1, 2, 3 and 4, an electrical connector 60, also fabricated of an insulating material, for example, ABS or nylon, includes a complexly configured connector body 62 which receives, supports and positions a pair of electrical terminals 64*a* and 64*b* and a cover 66 which is removably retained on the body 62 by a latch assembly 68. The connector body 62 includes a pair of parallel, spaced-apart outer ears or flanges 72*a* and 72*b* which are each reinforced by pairs of gussets 74 and a center flange or tongue 76 perpendicular to and offset from the outer flanges 72*a* and 72*b* which is also strengthened by a pair of gussets 78. As indicated by the arrows in FIG. 1, when the electrical connector 60 is assembled to the terminal assembly 30, each of the pair of ears or flanges 72*a* and 72*b* is received within a respective one of the pair of rectangular slots 36*a* and 36*b*. Also, as illustrated in FIG. 2, when the electrical connector 60 is assembled to the terminal assembly 30, the center flange or tongue 76 is in intimate contact with the surface of the terminal assembly 30 around the aperture 48 and closes and seals it off.

The pair of electrical terminals 64*a* and 64*b* in the electrical connector 60 are flat, resilient, blade-like components which may be crimped to respective electrical leads 84 and which may be molded in-situ in the electrical connector 60 or secured there by other conventional, for example, mechanical, means. Generally aligned with the center flange 76 is a resilient latch member 86 which releasably engages a cross member 88 of the terminal assembly 30, as illustrated in FIG. 2, to retain the electrical connector 60 on the terminal assembly 30. A U-shaped bridge 94, aligned with the center flange 76 and the resilient latch member 86 reinforces the electrical connector 60, protects and acts as a locating reference for the latch member 86 and facilitates installation of the electrical connector 60 on the terminal assembly 30.

Figure 5:
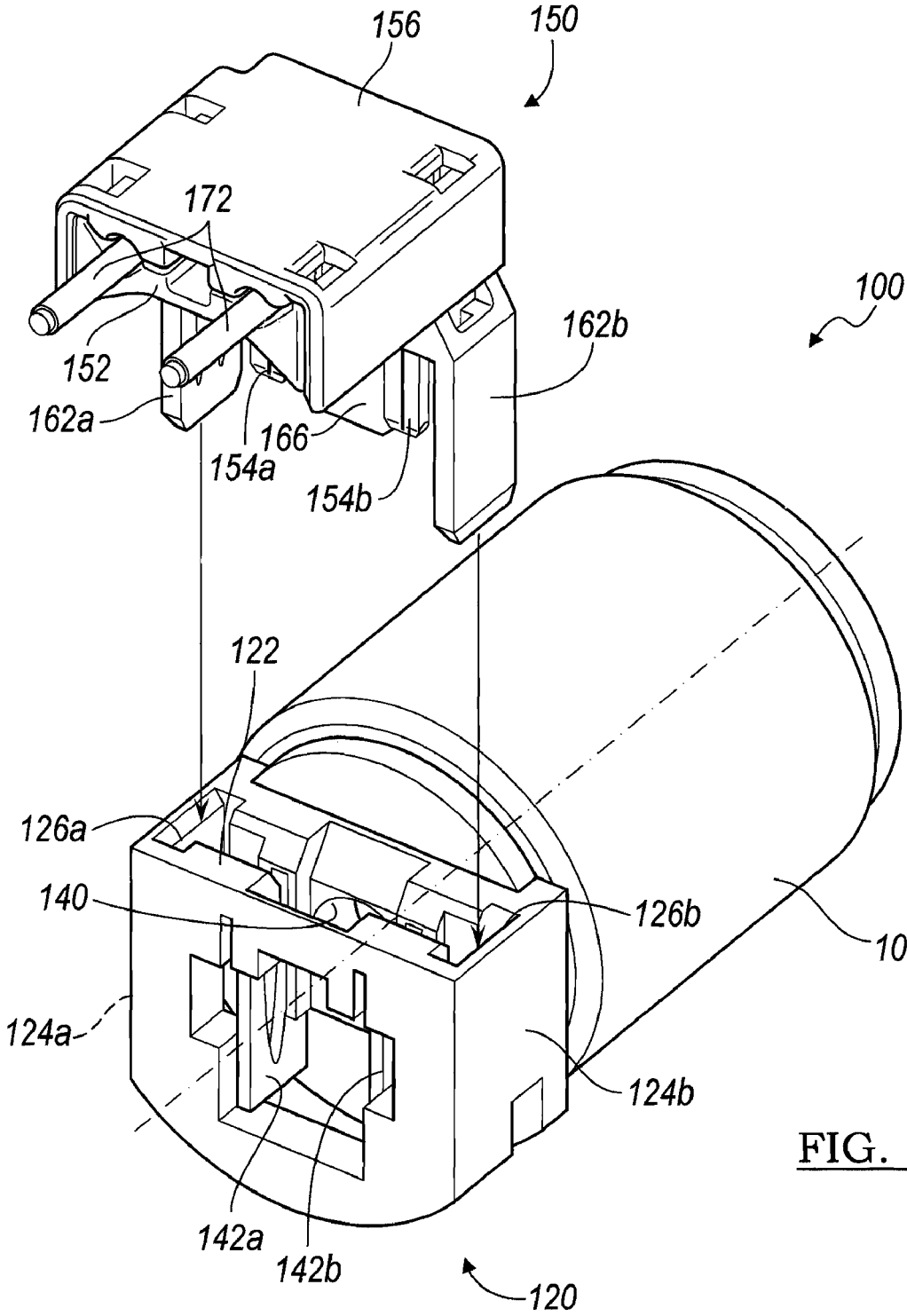
FIG. 5 is a perspective view of a second embodiment of a motor and an electrical connector according to the present invention in pre-assembly configuration.
Figure 6:
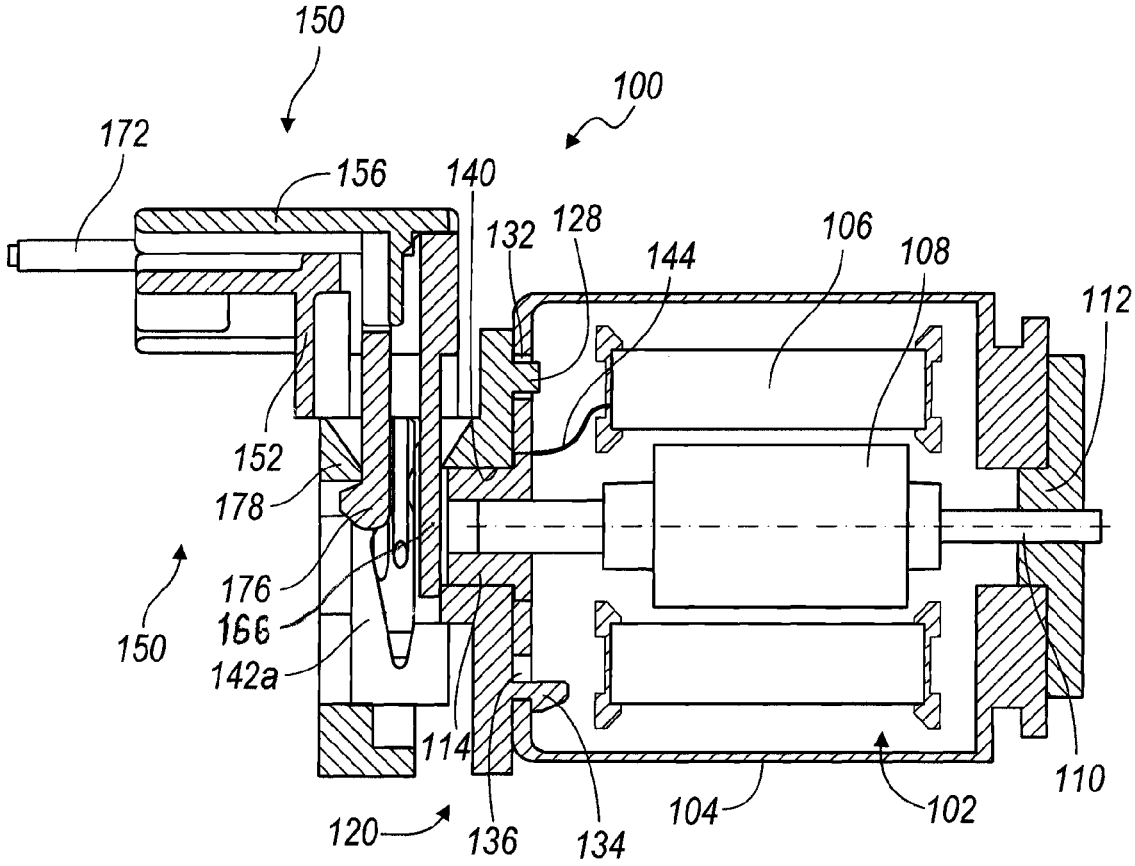
FIG. 6 is a full, sectional view of a second embodiment of a motor and an electrical connector assembly according to the present invention.

Referring now to FIGS. 5 and 6, a second embodiment of the invention having an electric motor and an electrical connector assembly according to the present invention is illustrated and generally designated by the reference number 100. The second embodiment motor and electrical connector assembly 100 is similar to the first embodiment assembly 10 except that the solenoid 12 is replaced by an electric motor 102 and an electrical connector 150 includes electrical leads 172 which extend from the connector 150 in an opposite direction. It should be appreciated that these various components may be interchanged and that the solenoid 12 of the first embodiment assembly 10 may be utilized with the electrical connector 150 of the second embodiment assembly 100 and that the electric motor 102 of the second embodiment assembly 100 may be utilized with the electrical connector 60 of the first embodiment assembly 10.

The second embodiment motor and electrical connector assembly 100 includes the electric motor 102 which may be either uni- or bi-directional and which has a generally cylindrical housing 104 which is preferably fabricated of metal, for example, steel, aluminum or an alloy of these or other metals. The cylindrical housing 104 locates, supports and protects a stator and electrical coil 106. The stator and electrical coil 106 generally surrounds a rotatable armature 108 having a shaft 110 which defines an axis of rotation. The armature 108 cooperates with and is supported by a first guide or bearing 112 and a second guide or bearing 114 which together define the axis of motion or rotation of the armature 108.

At the end of the cylindrical housing 104 opposite the first guide or bearing 112 is disposed a terminal assembly 120. The terminal assembly 120 is fabricated of a plastic, insulating material, for example, ABS or nylon, and is shaped to generally conform to the housing 104 of the electric motor 102 and includes a flat, chordal surface 122 flanked by two smaller perpendicular surfaces 124*a* and 124*b*. The terminal assembly 120 defines a pair of rectangular slots 126*a* and 126*b* parallel to and adjacent the surfaces 124*a* and 124*b*, respectively. The terminal assembly 120 is secured to the cylindrical housing 104 by a positioning or register pin 128 which is received within a suitably sized and appropriately located opening 132 and a resilient latch 134 which is releasably received within a second opening 136 having a flat or chordal edge which is engageable by the latch 134.

The terminal assembly 120 includes a centrally disposed aperture 140 which receives a portion of the second guide or bearing 114. The terminal assembly 120 also includes a pair of spaced apart electrical terminals 142*a* and 142*b* disposed adjacent and on opposite sides of the center aperture 140. Each of the terminals 142*a* and 142*b* is connected to a respective one of the electrical leads or wires 144 of the electric coil 106 of the electric motor 102.

Figure 3:
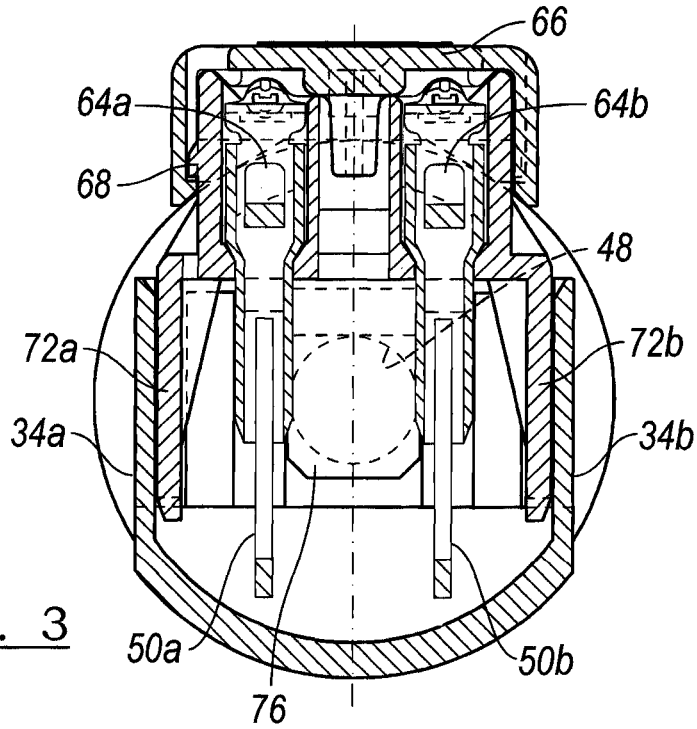
FIG. 3 is a full, sectional view of a first embodiment of an electrical connector according to the present invention taken along line 3-3 of FIG. 2.
Figure 4:
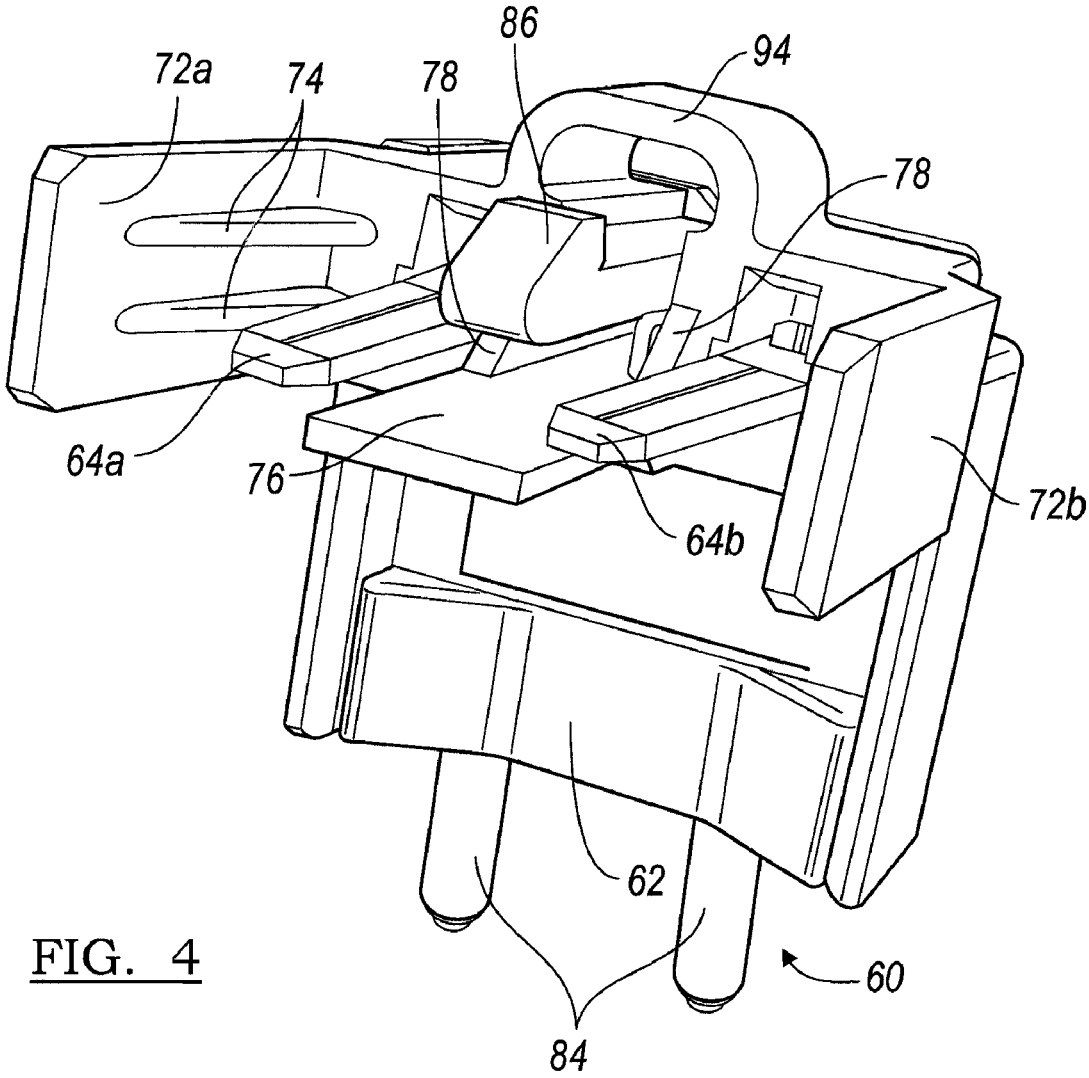
FIG. 4 is a perspective view of a first embodiment of an electrical connector according to the present invention.

An electrical connector 150, also fabricated of an insulating material, for example, ABS or nylon, includes a complexly configured body 152 which receives, supports and positions a pair of electrical terminals 154*a* and 154*b* and a cover 156 which is removably retained on the body 152 by a latch assembly 68 (illustrated in FIG. 3). The connector body 152 includes a pair of parallel, spaced-apart outer ears or flanges 162*a* and 162*b* which are reinforced by pairs of gussets 74 (illustrated in FIG. 4) and a center flange or tongue 166 perpendicular to and offset from the outer ears or flanges 162*a* and 162*b*. The center flange or tongue 166 is strengthened by a pair of gussets 78 (illustrated in FIG. 4). As indicated by the arrows in FIG. 5, when the electrical connector 150 is assembled to the terminal assembly 120, each of the pair of ears or flanges 162*a* and 162*b* is received within a respective one of the pair of rectangular slots 126*a* and 126*b*. Also, as illustrated in FIG. 6, when the electrical connector 150 is assembled to the terminal assembly 120, the center flange or tongue 166 is in intimate contact with the terminal assembly 120 around the aperture 140 and closes and seals it off.

The pair of electrical terminals 154*a* and 154*b* in the electrical connector 150 are flat, resilient, blade-like components which may be crimped to respective electrical leads 172 and which may be molded in-situ in the electrical connector 150 or secured there by other conventional, for example, mechanical, means. Generally aligned with the center flange 166 is a resilient latch member 176 which engages, as illustrated in FIG. 6, a cross member 178 of the terminal assembly 120 to retain the electrical connector 150 on the terminal assembly 120.

It will be appreciated that in the first embodiment solenoid and electrical connector assembly 10, the center flange or tongue 76 effectively covers and protects the center aperture 48 inhibiting the ingress of foreign material which could cause a short circuit between one of the electrical terminals 50*a* and 50*b* and the chassis ground through the second guide, pole piece or stop 24 when the electrical connector 60 is assembled to the terminal assembly 30. Likewise, in the second embodiment motor and electrical connector assembly 100, the center flange or tongue 166 effectively covers and protects the center aperture 140 inhibiting the ingress of foreign material which could cause a short circuit between one of the electrical terminals 142*a* and 142*b* and the chassis ground through the second guide or bearing 114 when the electrical connector 150 is assembled to the terminal assembly 120.

The description of the invention is merely exemplary in nature and variations that do not depart from the gist of the invention are intended to be within the scope of the invention. Such variations are not to be regarded as a departure from the spirit and scope of the invention.

What is claimed is:

1. A electrical component and connector assembly comprising, in combination, a electrical component having a housing including a pair of aligned guides defining an axis of motion and a member disposed for motion on said axis, a terminal assembly secured to said housing defining an opening that at least partially receives at least one of said guides and including a first pair of electrical terminals adjacent said opening, and an electrical connector having a second pair of electrical terminals disposed to engage a respective one of said first pair of electrical terminals and a tongue configured to cover said opening of said terminal assembly when said connector is assembled to said terminal assembly, wherein said tongue includes reinforcing gussets.

2. The electrical component and connector assembly of claim 1 wherein said electrical component is a solenoid.

3. The electrical component and connector assembly of claim 1 wherein said electrical component is a motor.

4. The electrical component and connector assembly of claim 1 wherein said member is a solenoid plunger.

5. The electrical component and connector assembly of claim 1 wherein said member is a motor armature.

6. The electrical component and connector assembly of claim 1 further including a cover releasably attached to said electrical connector.

7. The electrical component and connector assembly of claim 1 wherein said terminal assembly includes a pair of spaced apart slots and said electrical connector includes a pair of spaced apart ears adapted to engage said slots of said terminal assembly.

8. A solenoid and connector assembly comprising, in combination, a solenoid having a housing, an electrical coil in said housing, a pair of aligned guides defining an axis of motion inside said coil and a plunger disposed for motion on said axis, a terminal assembly secured to said housing defining an opening for receiving one of said guides and including a first pair of electrical terminals connected to said coil and disposed adjacent said opening, and an electrical connector having a second pair of electrical terminals configured to engage a respective one of said first pair of electrical terminals and a tongue disposed to cover said opening when said connector is assembled to said terminal assembly.

9. The solenoid and connector assembly of claim 8 wherein said tongue includes reinforcing gussets.

10. The solenoid and connector assembly of claim 8 further including a cover releasably attached to said electrical connector.

11. The solenoid and connector assembly of claim 8 further including electrical leads connected to said second pair of electrical terminals and extending along said housing.

12. The solenoid and connector assembly of claim 8 further including electrical leads connected to said second pair of electrical terminals and extending away from said housing.

13. The solenoid and connector assembly of claim 8 wherein said guides are electrically conductive and said terminal assembly is an insulator.

14. The solenoid and connector assembly of claim 8 wherein said terminal assembly includes a pair of spaced apart slots and said electrical connector includes a pair of spaced apart ears adapted to engage said slots of said terminal assembly.

15. An electric motor and connector assembly comprising, in combination, an electric motor having a housing, an electrical coil in said housing, a pair of aligned bearings defining an axis of rotation inside said coil and an armature disposed for rotation on said axis, a terminal assembly secured to said housing defining an opening for receiving one of said bearings and including a first pair of electrical terminals connected to said coil and disposed adjacent said opening, and an electrical connector having a pair of spaced apart ears adapted to engage said terminal assembly, a second pair of electrical terminals configured to engage a respective one of said first pair of electrical terminals and a tongue disposed to cover said opening when said connector is assembled to said terminal assembly.

16. The electric motor and connector assembly of claim 15 further including a cover releasably attached to said electrical connector.

17. The electric motor and connector assembly of claim 15 further including electrical leads connected to said second pair of electrical terminals and extending along said housing.

18. The electric motor and connector assembly of claim 15 further including electrical leads connected to said second pair of electrical terminals and extending away from said housing.

19. The electric motor and connector assembly of claim 15 wherein said motor is bi-directional.

* * * * *